US009700180B1

(12) United States Patent
Zuravsky et al.

(10) Patent No.: US 9,700,180 B1
(45) Date of Patent: Jul. 11, 2017

(54) PRE-CONFORMED WASH VESSEL LINER SYSTEM AND METHOD

(71) Applicant: Rhoda Sherwin Zuravsky, Columbus, OH (US)

(72) Inventors: Rhoda Sherwin Zuravsky, Columbus, OH (US); Marvin A. Zuravsky, Columbus, OH (US)

(73) Assignee: Rhonda Sherwin Zuravsky, Columbus, OH (US)

( * ) Notice: Subject to any disclaimer, the term of this patent is extended or adjusted under 35 U.S.C. 154(b) by 0 days.

(21) Appl. No.: 15/367,758

(22) Filed: Dec. 2, 2016

Related U.S. Application Data

(63) Continuation-in-part of application No. 14/961,493, filed on Dec. 7, 2015, now abandoned, which is a continuation-in-part of application No. 13/895,847, filed on May 16, 2013, now abandoned.

(60) Provisional application No. 61/688,733, filed on May 18, 2012.

(51) Int. Cl.
*A47K 3/022* (2006.01)
*A47K 3/00* (2006.01)
*A47K 3/12* (2006.01)

(52) U.S. Cl.
CPC ..... *A47K 3/001* (2013.01); *A47K 3/122* (2013.01); *A47K 3/125* (2013.01)

(58) Field of Classification Search
CPC ..... A47K 3/002; A47K 3/001
USPC ..... 4/580–583
See application file for complete search history.

(56) References Cited

U.S. PATENT DOCUMENTS

| | | | |
|---|---|---|---|
| 455,429 | A | 7/1891 | McDonald |
| 550,542 | A | 11/1895 | Smith |
| 1,081,987 | A | 12/1913 | Price, Jr. |
| 1,665,206 | A | 4/1928 | Henry |
| 1,681,294 | A | 8/1928 | Henry |
| 1,961,360 | A | 6/1934 | Herndon, Jr. et al. |
| 2,319,603 | A | 5/1943 | Henry |
| 2,541,029 | A | 2/1951 | Burton |
| 3,892,000 | A | 7/1975 | Morse |
| 3,931,651 | A | 1/1976 | Weir |
| 3,938,200 | A | 2/1976 | Roberts et al. |
| 4,051,563 | A | 10/1977 | Clarke |
| 4,069,523 | A | 1/1978 | Ridgeway |
| 5,153,950 | A | 10/1992 | Sowers |
| 5,173,346 | A | 12/1992 | Middleton |
| 5,216,764 | A | 6/1993 | Hall et al. |

(Continued)

OTHER PUBLICATIONS

Colonial Medical Product Information for Sani-Tub Disposable Tub Liner, retrieved from http://www.colonialmedical.com/sani-tub-disposiable-tub-liner-P-3550.html on Nov. 30, 2015.

*Primary Examiner* — Christine Skubinna
(74) *Attorney, Agent, or Firm* — James R. Eley; Ronald J. Koch; Eley Law Firm Co, LPA

(57) ABSTRACT

A bathtub liner system for a bathtub includes a basin, a cushion, and a drain system. The basin includes a first end portion, a second end portion and opposing side portions all extending from and adjacent to a bottom portion. The first end portion is adjacent to first ends of the side portions, and the second end portion is adjacent to second ends of the side portions. The basin is pre-conformed to generally match a contour of at least a portion of the bathtub, and is configured to receive and contain a fluid. The drain system is configured to be selectively sealed to retain or drain the fluid at an opening in the basin.

20 Claims, 18 Drawing Sheets

(56) References Cited

U.S. PATENT DOCUMENTS

| | | | |
|---|---|---|---|
| 5,742,955 | A | 4/1998 | Parkay et al. |
| 5,829,071 | A | 11/1998 | Lavalle |
| 6,085,367 | A | 7/2000 | Guiste |
| 2006/0073750 | A1 | 4/2006 | Schindzielorz |
| 2008/0216228 | A1 | 9/2008 | Bonanno |
| 2009/0106889 | A1 | 4/2009 | Brown |
| 2010/0235980 | A1 | 9/2010 | Fowkes |
| 2013/0340159 | A1 | 12/2013 | Barrett |

PRE-CONFORMED WASH VESSEL LINER SYSTEM AND METHOD

CROSS-REFERENCE TO RELATED APPLICATIONS

This application is continuation-in-part of U.S. patent application Ser. No. 14/961,493, filed Dec. 7, 2015, which is a continuation-in-part of U.S. patent application Ser. No. 13/895,847, filed May 16, 2013, and entitled "Washable Bathtub Liner", which claims priority to U.S. provisional application 61/688,733, filed May 18, 2013, and entitled "Tub Liner", the entire contents of each of these applications being hereby incorporated by reference.

FIELD

The present invention relates generally to wash vessels (aka wash basin, receptacle) liners (e.g. bathtub & shower liners). In particular, the present invention relates to a one-piece, washable bathtub liner system that includes a pre-conformed contoured shape configured to match an adjacent bathtub surface, integral back and seat cushions, and a drainage system.

BACKGROUND

Conventional bathtub liners may be used to provide sanitary protection for users of the tubs or to protect the tub surface from stains, debris, or hard to clean materials. Certain applications such as oatmeal baths or pet bathing may lend themselves to utilizing disposable or washable liners in the bathtub. These liners may be formed of various thin, flexible, sheeting materials, including paper products, to allow for disposability. Yet, paper or fabric liners fail to provide a water-tight reusable receptacle. Some liners are formed from simple plastic rectangular sheets, but result in excessive and unsightly leftover material gathering in the corners of the tubs when installed. Thus, the excess corner material provides crevices that can collect dirt and oil.

Many users typically prefer utilizing a tub liner with built-in cushioning that isolates the user from the hard surface of the underlying bathtub. However, liners formed from foam or other cushioning material may suffer from excessive weight, cost, and difficulty in cleaning. Other known bathtub liners are formed of irregular patterns cut from rectangular sheets to allow for ease in cleaning and folding the material. Such foldable pattern liners include a main portion and laterally extending side portions. However, such foldable pattern liners or other piecemeal liners fail to provide a self-contained water receptacle having an interior that is totally isolated from the tub interior. Some known liners are formed pre-conformed yet lack an upper ledge with selective semi-rigidity to easily support the liner against the bathtub ledge. Such liners thus require multiple clips, magnets or suction cups to secure the liner to the top ledge of the bathtub for support. Other known liners may be self-contained one-piece members, but use or require perforation of a drain opening at the end of use to remove fluid.

There remains a need for a one-piece, generally water-tight, re-usable, pre-conformed bathtub liner that conforms to the contours of a bathtub. There remains a need for a liner system including a selectively semi-rigid ledge to add support. There is also a need for a bathtub liner including integral back and seat cushions, and an integral built-in drain system that overcomes the above drawbacks.

SUMMARY

A bathtub liner system for a bathtub is disclosed according to an embodiment of the present invention. The liner system includes a basin, a cushion, and a drain system. The basin includes a first end portion, a second end portion and opposing side portions all extending from and adjacent to a bottom portion. The first end portion is adjacent to first ends of the side portions, and the second end portion is adjacent to second ends of the side portions. The basin is configured to receive and contain a fluid. The cushion is coupled to an interior surface of the basin. The drain system is operatively coupled to the basin, and configured to be selectively sealed to retain or drain the fluid at an opening in the basin. The basin is pre-conformed to generally match a contour of at least a portion of the bathtub.

In one embodiment the disclosed invention includes a bathtub liner system for a bathtub including a basin pre-conformed to generally match a contour of at least a portion of the bathtub and configured to receive and contain a fluid. The basin is formed by heat welding of separate liner material portions to be a one-piece member. The liner system further including a back cushion extending from an interior surface of a first end portion of the basin and a seat cushion extending from an interior surface of a bottom portion of the basin. The drain system is operatively coupled to the basin, and configured to be selectively sealed to retain or drain the fluid at an opening in the basin. The basin is pre-conformed to generally match a contour of at least a portion of the bathtub.

In one embodiment the disclosed invention includes a method for assembling a bathtub liner system for a bathtub. The method includes obtaining a basin including a first end portion, a second end portion, opposing side portions, and a bottom portion. The method includes connecting the first and second end portions to extend from the bottom portion and connecting the opposing side portions to extend from the bottom portion. The method includes connecting the first end portion to first ends of the side portions and connecting the second end portion to second ends of the side portions. The method further includes pre-conforming the basin to generally match a contour of at least a portion of the bathtub and configuring the basin to receive and contain a fluid. The method includes coupling a cushion to an interior surface of the basin and operatively coupling a drain system to the basin, the drain system configured to be selectively sealed to retain or drain the fluid at an opening in the basin.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
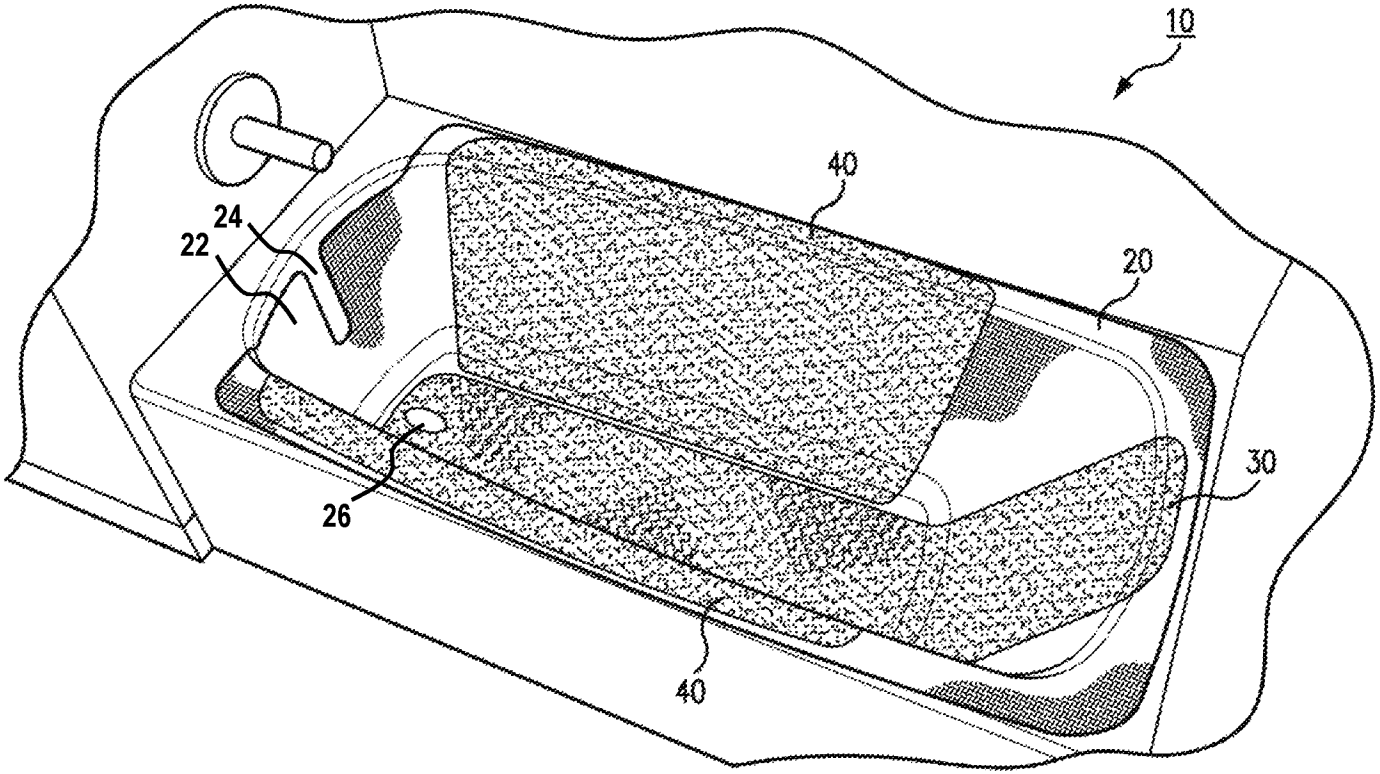
FIG. 1 is a top perspective view of a bathtub liner according to an embodiment of the present invention.

In the discussion that follows, like reference numerals are used to refer to like structures and elements in the various figures.

Figure 2:
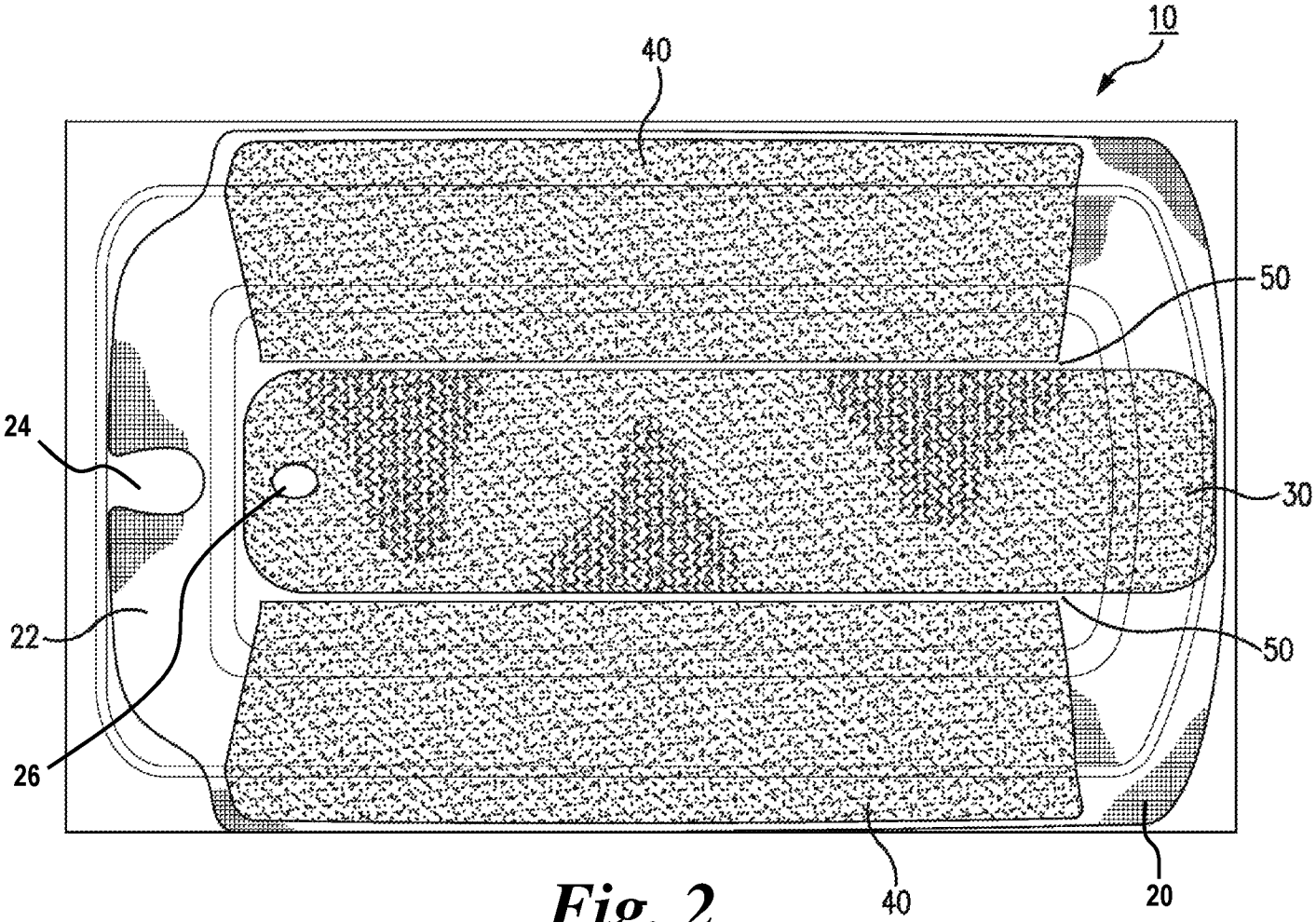
FIG. 2 is a top plan view of the bathtub liner of FIG. 1.
Figure 3:
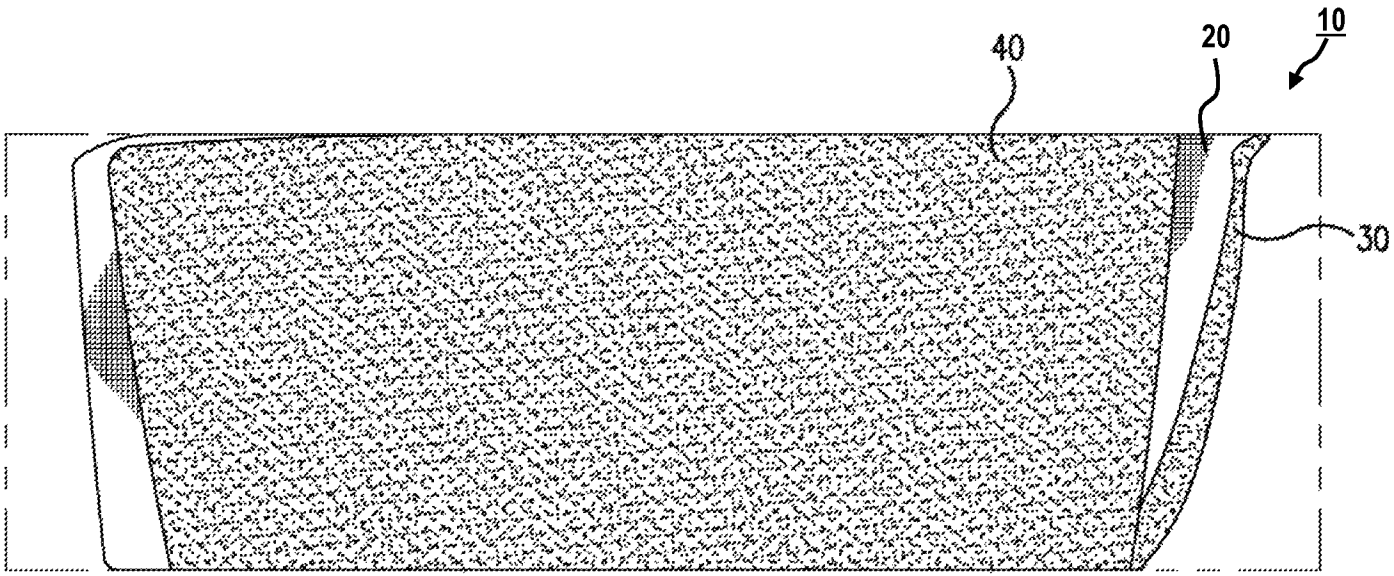
FIG. 3 is a side elevational view of the bathtub liner of FIG. 1.
Figure 4:
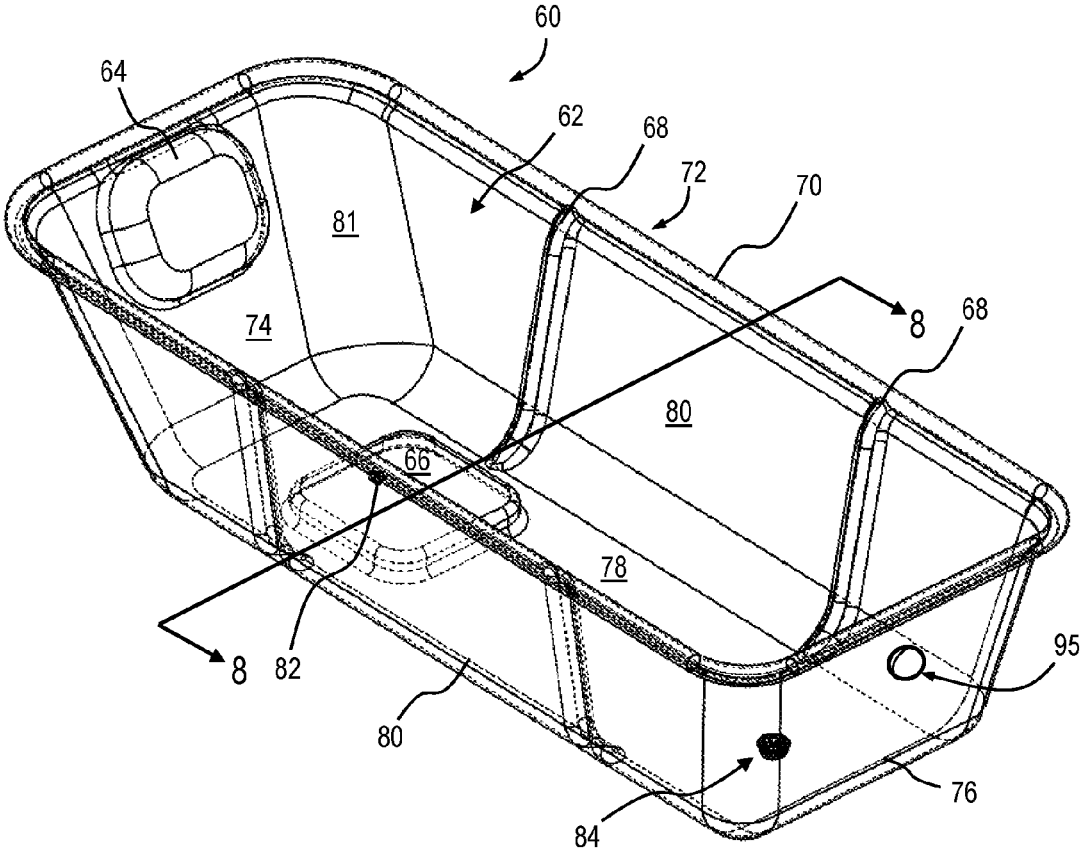
FIG. 4 is a top perspective view of a bathtub liner system shown transparent according to an embodiment of the present invention.
Figure 5:
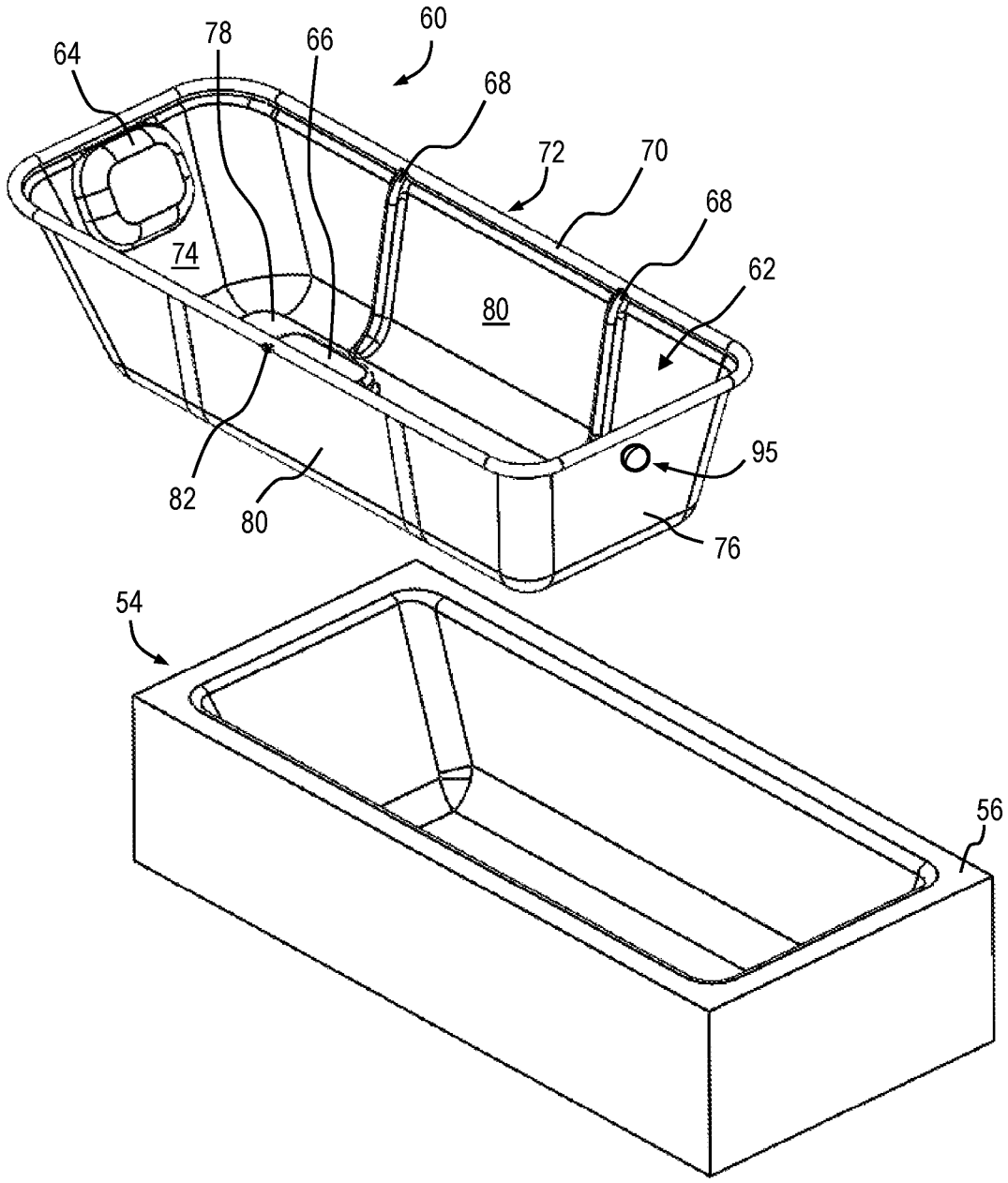
FIG. 5 is an exploded view of the bathtub liner of FIG. 4 shown opaque and with a bathtub.
Figure 6:
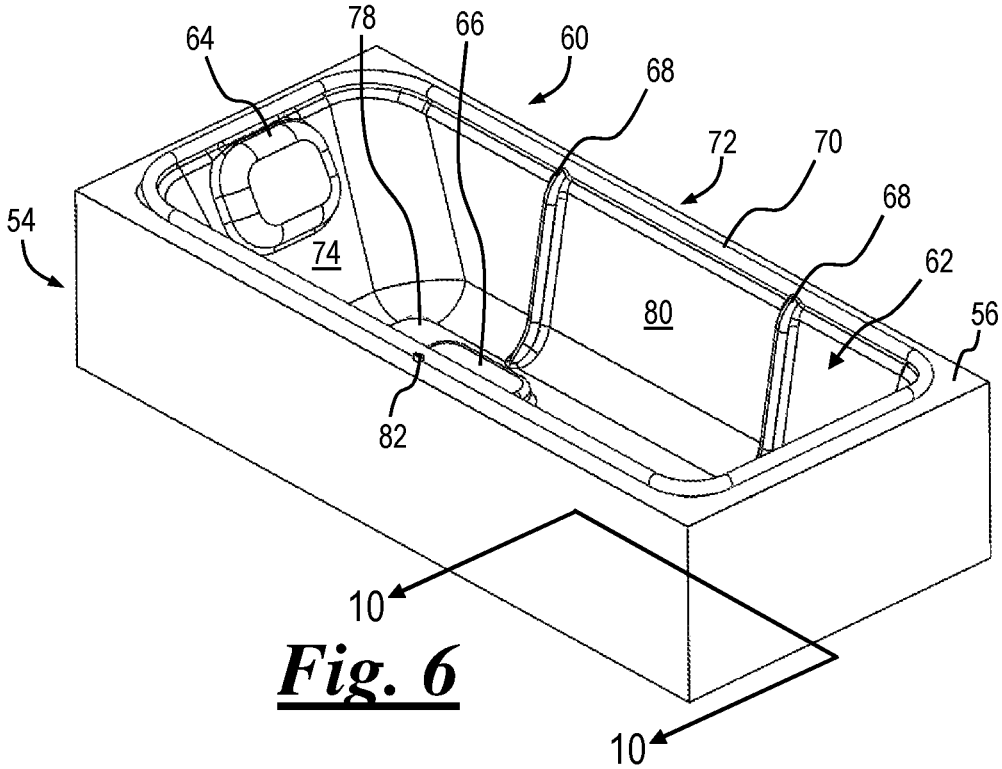
FIG. 6 is an assembled view of the bathtub liner of FIG. 5 with the bathtub.

With reference to FIGS. 1-3, in one embodiment a washable bathtub liner 10 is shown in use within a conventional bathtub. The tub is defined by a bottom, back, side edges, a drain, and a faucet. As shown, liner 10 includes cutouts that permit access to the drain and faucet with liner 10 secured to the bottom of the tub. It is also within the scope of the present invention to utilize the liner 10 in connection with tubs of various shapes and sizes. The liner 10 may also be used in connection with any suitable receptacle, such as totes, sinks or large basins.

The various components of liner 10 are best illustrated in FIG. 2. This figure shows that liner 10 is preferably formed from a flexible fabric layer 20 with a series of polymeric panels 30, 40 that are bonded to the fabric layer. This flexible layer 20 includes forward and rearward edges and opposing side edges. A narrowed region 22 is formed along the forward edge of the fabric layer 20. This narrowed region 22 includes a cutout 24 that is adapted to receive the faucet or other plumbing feature. The narrowed region 22 may be formed from silicone as opposed to fabric to give the liner more rigidity in this area. The rearward end of the fabric layer 20 is adapted to be positioned over the back of the tub. The central panel 30 is elongated and, when in position, extends along the back side of the tub and may extend to the rearward edge of the flexible layer 20. This allows the central panel 30 to act as a cushion for a person reclining in the tub (see FIG. 3). The central panel 30 includes a cutout 26 that is adapted to fit about the drain or other plumbing feature.

Side panels 40 are formed on opposing sides of central panel 30 and extend to the opposing side edges of the flexible layer 20. The opposing edges of side panels 40 are adapted to be fitted over the side edges of the tub. Thus, when getting out of the tub, the user may grip panels 40 as opposed to the surface of the tub. Panels 30 and 40 may include a texturized upper surface to facilitate gripping and to provide tactile feedback (e.g. for the blind, or weak-sighted). In one embodiment suction cups may be included on the bottom of the fabric layer 20 to promote adhesion between the layer and the tub. Spaces 50 are formed between the side panels 40 and the central panel 30. Spaces 50 permit the bathtub liner to be folded when not in use. In one embodiment, spaces 50 allow the entire liner to be folded into approximately thirds for storage and transport.

In one embodiment, the flexible layer 20 is formed from a durable nylon fabric and panels 30, 40 are formed from silicone. Alternatively, the panels may be formed from other suitable polymer based materials. Preferably, the material allows the liner to be removed from the tub, washed and reused. In one embodiment, a disposable material, such as coated papers, may be used to make the tub liner fully disposable. The bonding of the panels 30, 40 to the fabric layer 20 may be achieved via an adhesive or via a heat seal. In one embodiment, flexible layer 20 is approximately 55 inches in length and between 30 to 32 inches wide. In one embodiment, central panel 30 is approximately 68 inches to 72 inches in length and 28 to 30 inches in length. In one embodiment, each of panels 40 is approximately 54 inches in length and 18 to 22 inches wide. The invention, however, is not limited to any specific dimensions, and the liner may be sized to fit each specific application of various receptacles.

The general arrangement of a bathtub liner system 60 is shown in FIGS. 4-17 according to another embodiment of the present invention. Liner system 60 includes a basin 62, a back cushion 64, and a seat cushion 66. Liner system 60 may optionally include support ribs 68 and an anchor ledge 70. Anchor ledge 70 is connected to an upper periphery of basin 62, and forms a continuous enclosure configured to receive and contain any suitable material that provides selective semi-rigidity. Suitable materials may include, without limitation, air, water, gel, beads or foam. Preferably, liner system 60 is assembled as a one-piece, unitary construction. Liner system 60 is configured to be prefabricated to be pre-conformed to the contours of a typical bathtub 54.

Figure 25:
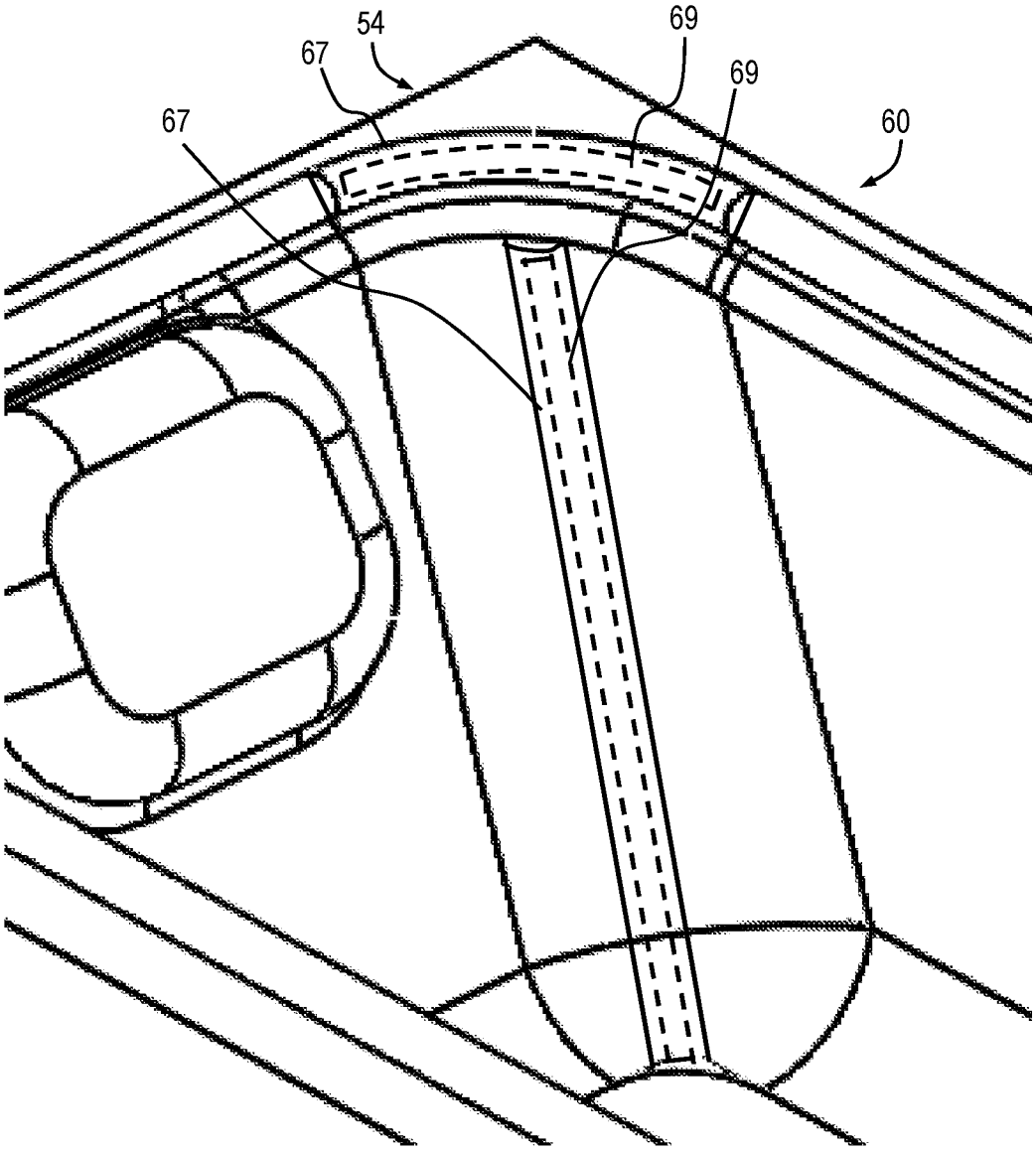
FIG. 25 is a partial end perspective view of the bathtub liner of FIG. 6 showing the support pockets according to another embodiment of the present invention.

In an alternative embodiment, liner system 60 may optionally include support pockets 67, preferably located at each corner of the liner. Support pockets 67 are configured to receive stays 69 (see FIG. 25), and to maintain the position and support of liner 60 as basin 62 is filled with fluid. Stays 69 are elongated, thin, semi-rigid members formed of plastic or other suitable durable material.

In use, basin 62 is configured to receive and contain an aqueous solution or other suitable material. Example suitable materials include, without limitation, bathwater, bubble bath, colloidal oatmeal dispersion, honey-milk solution, salt water solution, aromatic oils solution, seaweed mixtures, color dye solution, mud solutions, tomato juice solutions and pet flea treatment solution. Further, liner system 60 is configured to be secured against bathtub 54 or other suitable receptacle. Fluids or other materials supplied to liner system 60 apply force which acts to secure the system to the adjacent surface of bathtub 54. Support ribs 68 couple to anchor ledge 70, the combination forming frame 72 which acts to support liner system 60 while being filled with fluid and during use. Frame 72 is configured to selectively secure the bathtub liner system 60 against the adjacent surface of bathtub 54. After liner system 60 is placed within bathtub 54 and frame 72 has been filled with fluid or other suitable material, frame 72 becomes semi-rigidly self-supporting and secures the liner system against the bathtub even before basin 62 is filled with water. After use and during drainage of liner system 60, fluid may be released from frame 72, allowing the liner system to become more flaccid, and detach from bathtub 54.

Basin 62 includes a first end portion 74 and an opposing, second end portion 76, each of which is adjacent to bottom portion 78. First and second end portions 74, 76 are adjacent to opposing side portions 80, and to bottom portion 78. First end portion 74 is adjacent to side portions 80, and second end portion 76 is adjacent to opposing side portions. The term "adjacent" means adjacent regions or portions on a unitary piece and/or separate pieces connected to each other. Basin 62 may include radius portions 81 where the ends, sides and bottom portions meet. Although the shape of basin 62 is shown as generally rectangular, the shape may be oval, ovaloid, ovoid, circular, or a combination thereof.

Back cushion 64 extends from an interior surface of first end portion 74 and seat cushion 66 extends from an interior surface of bottom portion 78. Although only one of each cushion is shown, there may be included a plurality of cushions disposed on and extending from various locations of the basin 62. Preferably, back cushion 64 and seat cushion 66 are one-piece members manufactured as an integral part of the liner system 60 and configured to form an enclosure to receive and contain any suitable fill material, such as air. In one embodiment, back cushion 64 and/or seat cushion 66 are in fluid communication with frame 72 such that fluid introduced into the frame also fills the cushions.

In an alternative embodiment, back cushion 64 and seat cushion 66 are separate pieces attached to basin 62. The attachment may be any suitable type, such as by ultrasonic welding, heat sealing, fastener or adhesive. In one embodiment, back cushion 64 and/or seat cushion 66 are selectively coupled to basin 62 by releasable fasteners or selectively coupled to bathtub 54 by releasable magnets. In a further embodiment, back cushion 64 and seat cushion 66 are configured for individualized adjustable positioning relative to basin 62. The cushions may be adjustably coupled to a strap or straps attached to basin 62 or may include magnetic or other releasable fasteners.

Back cushion 64 and seat cushion 66 may include one or more inlets and/or valves (not shown) configured to allow any suitable fluid, such as air, or other flowable material to be supplied or discharged. Preferably, the user would selectively inflate and deflate the cushions by supplying air to or discharging air from back cushion 64 and seat cushion 66 as needed. Other suitable fluids or materials used for fill may be, without limitation, water, gel, beads or foam. Back cushion 64 and/or seat cushion 66 may be factory pre-filled with suitable material, such as gel, beads or foam, and sealed. To help prevent the bottom portion 78 and/or first end portion 74 of liner system 60 from floating, seat cushion 66 and/or back cushion 64 may include or be formed of a mat made of silicone or other suitable material. In some embodiments, back cushion 64 and/or seat cushion 66 may include pockets or connectors for receiving removable inserts or backing (not shown) made of suitable material such as, without limitation, foam, rubber or silicone, thus allowing for greater ease of washing of liner system 60. In an alternative embodiment, liner system 60 may be configured open ended as a partial liner, and may not include a second end portion 76.

One or more of support ribs 68 may be disposed at any suitable location along opposing side portions 80 and/or first and second end portions 74, 76 of basin 62. Support ribs 68 may extend generally vertically downward from anchor ledge 70 toward bottom portion 78. Preferably, two spaced-apart support ribs 68 are disposed along each of opposing side portions 80. In some embodiments, support ribs 68 may be disposed at or proximate to corner joints where first and second end portions 74, 76 connect to opposing side portions 80. Support ribs 68 are configured to provide additional vertical support and may connect to and communicate with anchor ledge 70, to form a conduit enclosure that is configured to receive and contain a fluid or other material that provides selective semi-rigidity in order to fill frame 72.

Preferably, support ribs 68 and anchor ledge 70 are one-piece hollow tubular members manufactured as an integral part of the liner system 60. Support ribs 68 and anchor ledge 70 are preferably formed with generally cylindrical or oval cross sections (see FIG. 9), but may be formed in any suitable cross section. In an alternative embodiment, support ribs 68 and anchor ledge 70 are separate pieces attached to basin 62. The attachment may be any suitable type, such as by ultrasonic welding, heat sealing, fastener or adhesive. Support ribs 68 and/or anchor ledge 70 may be attached to basin 62 by a separate layer or pieces of liner material covering at least a portion of the ribs and/or ledge and which are secured to the basin by any suitable type, such as by heat sealing. In one embodiment, support ribs 68 and/or anchor ledge 70 may be formed by heat sealing or adhesive attachment of a second layer of liner material to a first layer of liner material.

In one embodiment, anchor ledge 70 may include one or more ledge portals 82 configured to allow fluid or other flowable material to be supplied to or discharged from the anchor ledge, and thus frame 72. Thus, the fluid or other flowable material provides selective semi-rigidity to frame 72. The user may supply air to and discharge air from frame 72 through the ledge portal 82. Other suitable fluids or materials may be used to fill frame 72, and may include, without limitation, water, gel, beads or foam. Alternatively, anchor ledge 70 and/or support ribs 68 may be factory pre-filled with suitable material, such as gel, beads or foam, and sealed. Once inflated, anchor ledge 70 expands to rest on an upper ledge 56 of bathtub 54. Ledge portal 82 preferably includes a closure and a normally-closed check valve feature to keep fluid from flowing back out of the anchor ledge 70. In one embodiment (FIG. 9), a pump 77 may be included as a kit with bathtub liner 60, and used to supply air to fill frame 72 through ledge portal 82.

In one embodiment, anchor ledge 70 and/or support ribs 68 may include one or more removable inserts 73 (see FIG. 12) made of suitable material such as, without limitation, foam, rubber or silicone. Inserts 73 provide selective semi-rigidity to anchor ledge 70 and/or support ribs 68, thus allowing for greater ease of washing of liner system 60. Inserts 73 may be formed from generally tubular foam members, and non-limiting example foam materials may include extruded or molded closed-cell polyethylene (PE) or low density polyethylene (LDPE).

Figure 7:
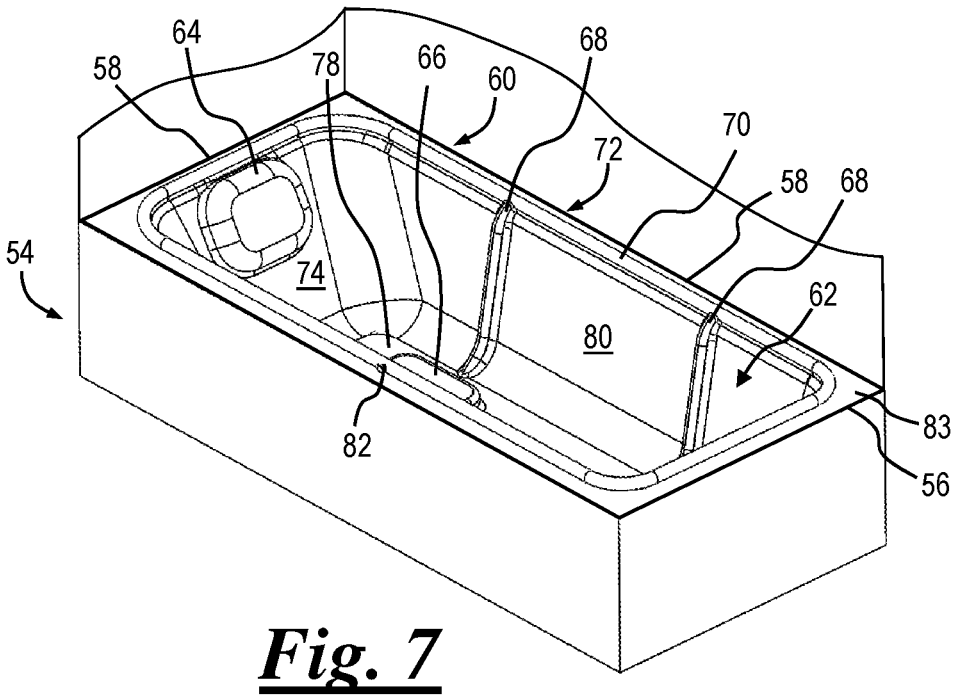
FIG. 7 is a top perspective view of the bathtub liner of FIG. 6 with a flange according to an embodiment of the present invention.
Figure 8:
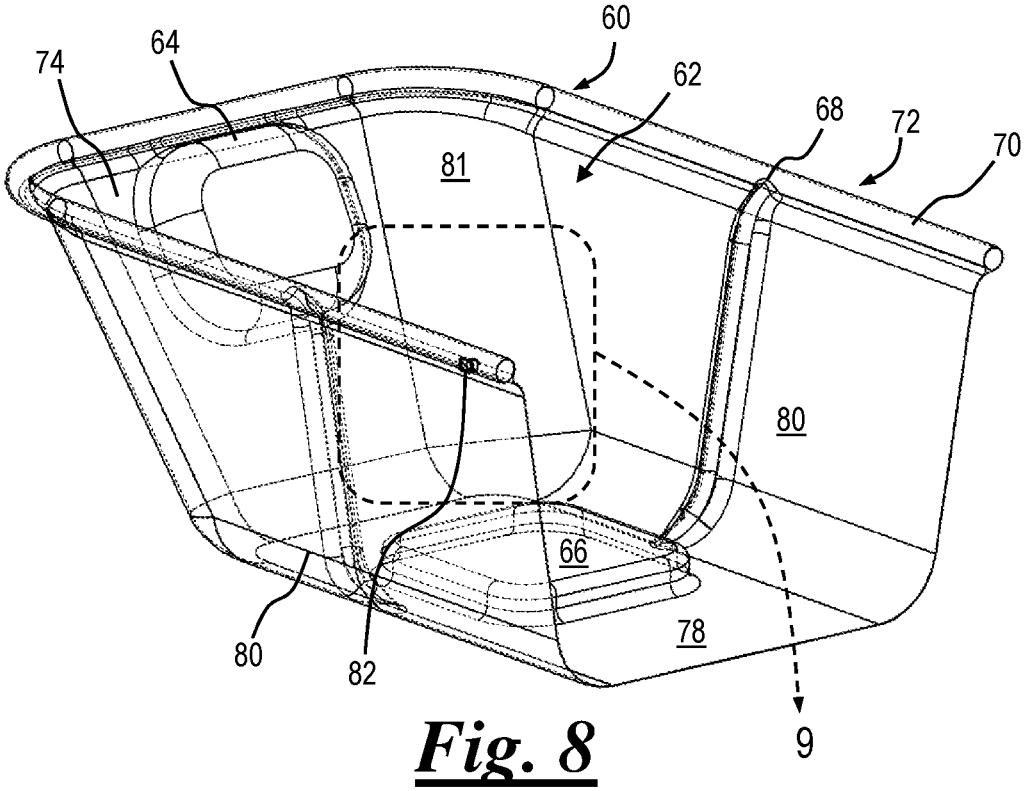
FIG. 8 is a side perspective view in section of the bathtub liner of FIG. 4.
Figure 9:
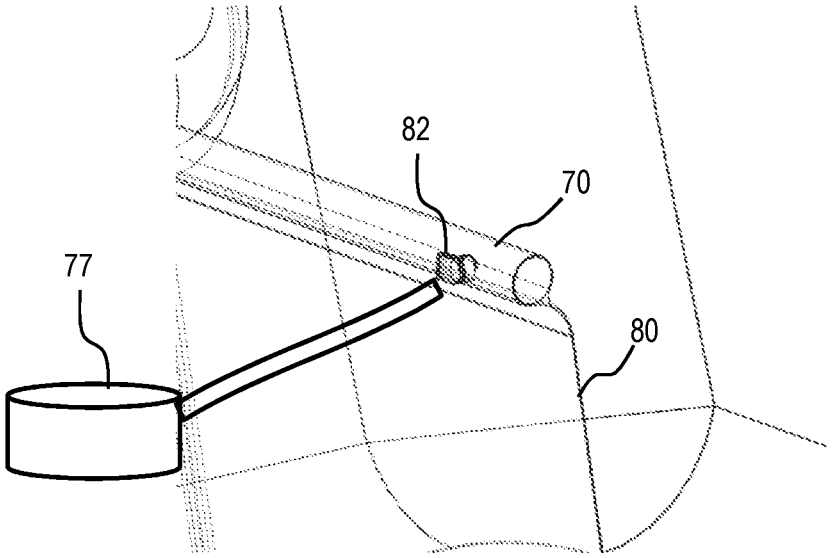
FIG. 9 is an enlarged view of the ledge portal of FIG. 8.
Figure 10:
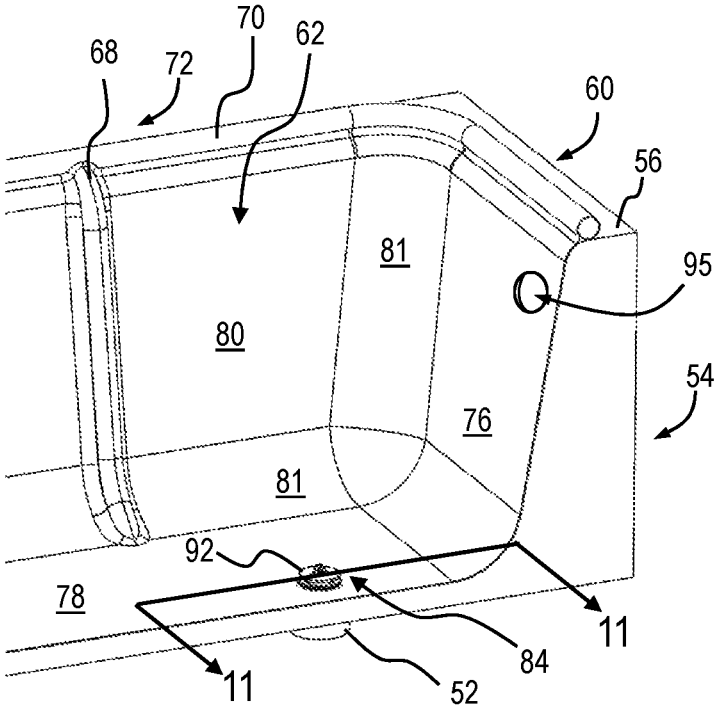
FIG. 10 is a partial side perspective view in section of FIG. 6.
Figure 11:
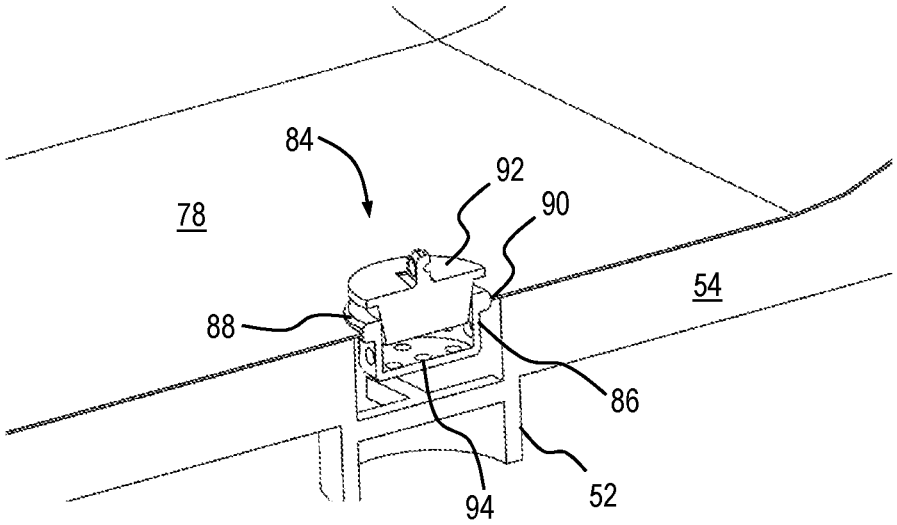
FIG. 11 is an enlarged view in side section of the drain system of FIG. 10.

Referring to FIG. 7, in one embodiment basin 62 includes an upper flange 83 configured to be received by adjacent ledge 56 and to have at least a portion extend to a wall joint 58 of bathtub 54. Upper flange 83 may be formed of liner material connected to or extending from at least a portion of the upper periphery of basin 62. Anchor ledge 70 may also be configured to be disposed on any position along upper flange 83, and may be located adjacent wall joint 58. As the wall joint area of a bathtub is difficult to keep clean, providing a barrier that extends to this area gives the user the ability to rest their arms and hands on the tub ledge without worrying about possible contaminants. In some embodiments, basin 62 may include flange 83 in lieu of anchor ledge 70, and may not extend to a wall joint (see FIG. 17), as in applications with a free-standing tub.

Bottom portion 78 may include a drain system 84 (best seen in FIGS. 10 and 11) configured to be selectively sealed to retain or drain fluid in basin 62. Drain system 84 includes a cup 86 having a rim 88 coupled or sealed to an opening 90 in basin 62. Drain system 84 further includes a plug 92 configured to be received by cup 86 and to selectively couple with the cup to form a substantially fluid-tight seal. Plug 92 may couple with cup 86 by any suitable feature such as by friction fit, or mated slots or threading. Preferably, drain system 84 is formed of plastic, rubber or other suitable material. Cup 86 includes openings 94 for fluid drainage and is configured to be received by or align with an existing drain 52 of bathtub 54. In an alternative embodiment, drain system 84 may include only rim 88 and a low profile plug 92, where plug 92 is configured to selectively seal rim 88 and coordinate with an adjacent pop-up style drain (not shown) of bathtub 54.

Figure 12:
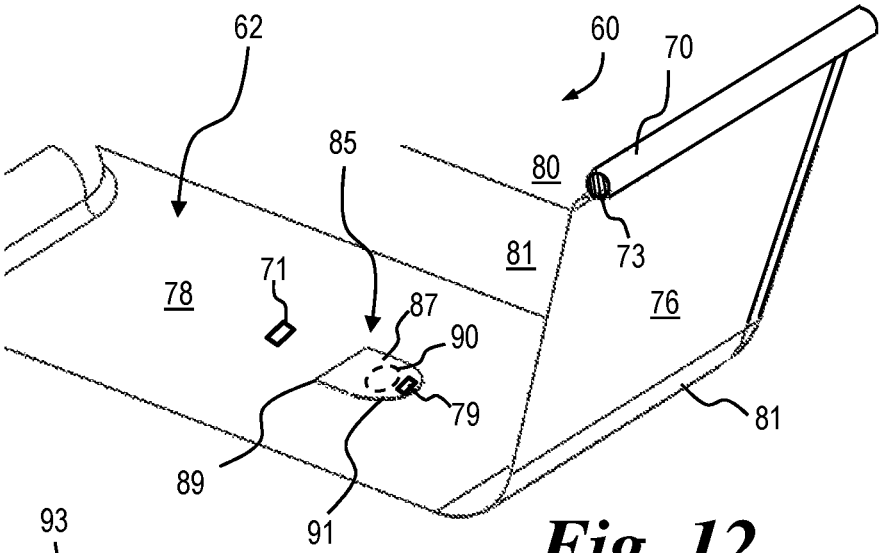
FIG. 12 is a partial side perspective view of a liner system in section showing an alternative drain system.
Figure 13B:
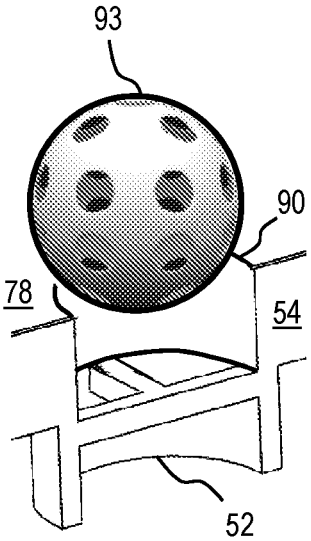
FIG. 13B is a cut-away view of the drain system of FIG. 13A with the flap removed for clarity.
Figure 13A:
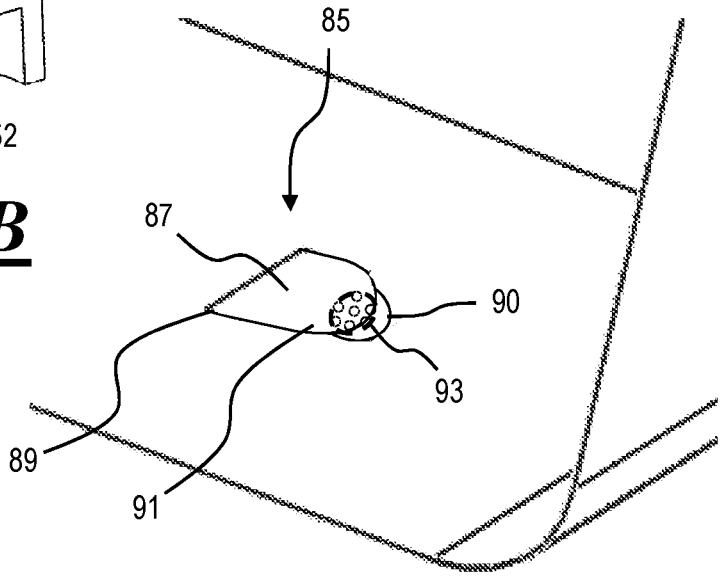
FIG. 13A is an enlarged view of the drain system of FIG. 12 with the flap in the open position and showing a prop in place.
Figure 14:
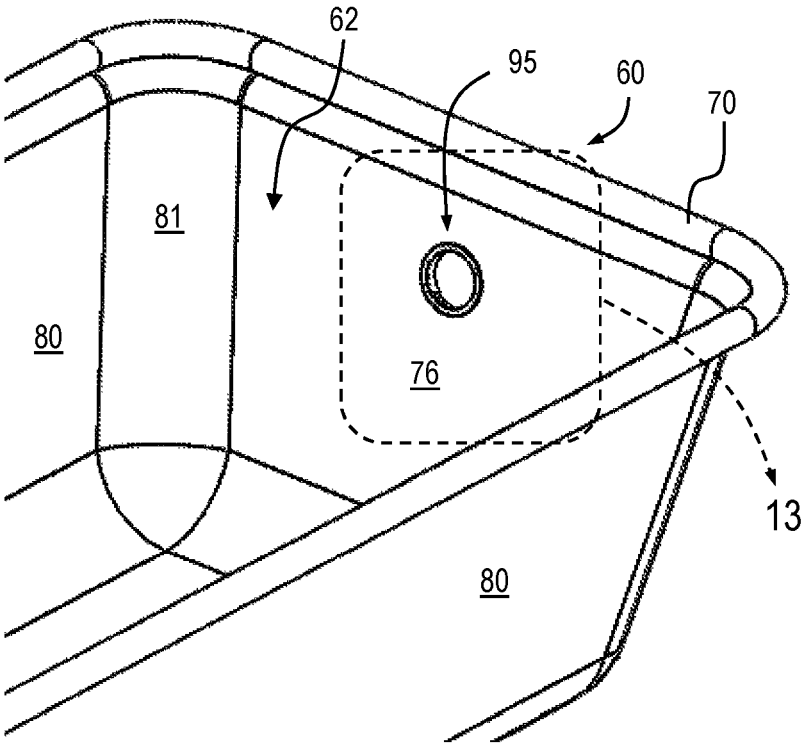
FIG. 14 is a partial end perspective view of the bathtub liner of FIG. 5 showing the overflow system.
Figure 15:
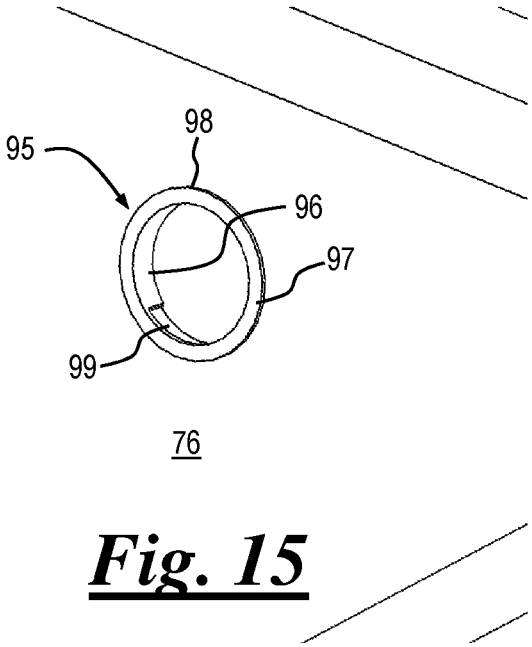
FIG. 15 is an enlarged view of the overflow system of FIG. 14.
Figure 16:
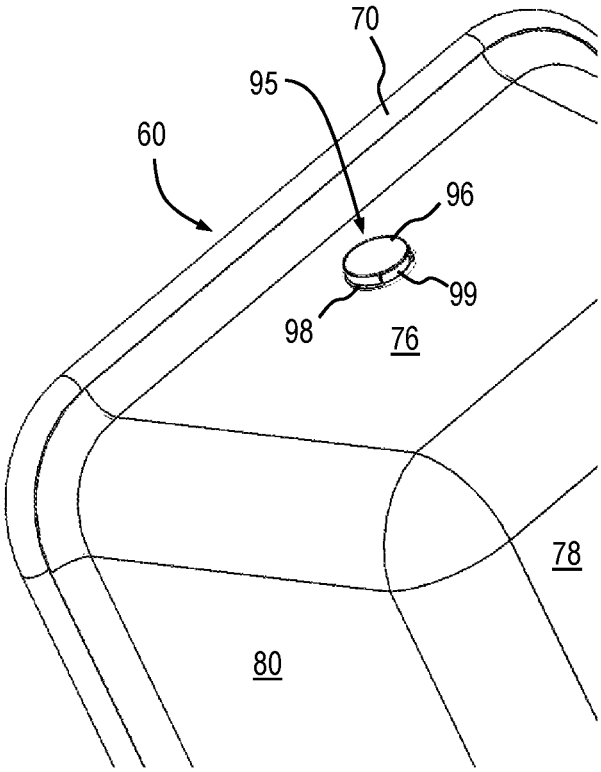
FIG. 16 is rear bottom exterior view of the overflow system of FIG. 14.

Referring to FIGS. 12 and 13A, in another embodiment, a drain system 85 may include a flap 87 configured to selectively seal opening 90 to contain fluid within basin 62. Flap 87 may have a first portion 89 securely coupled to bottom portion 78, and a second portion 91 configured for selectively sealing opening 90. Force from the standing fluid in basin 62 assists in sealing flap 87 against opening 90, thus keeping fluid from draining out during use. Once the user has finished using the fluid in the basin 62, they may open second portion 91 of flap 87 to release the fluid and drain the basin. Drain system 85 may also include a prop 93 configured to be placed between flap 87 and an adjacent surface of the bathtub 54 or liner system 60 (see FIG. 13A) to create a gap which assists with drainage of fluid from basin 62. Prop 93 may be formed preferably of a durable plastic, hollow, perforated sphere (see also FIG. 13B), and may optionally include a tether configured to couple the prop to basin 62. The perforations allow additional fluid drainage by reducing obstructions to fluid drainage flow. Optionally, prop 93 may include solid, non-perforated portions. Further, prop 93 may include weights, magnets or other suitable features to assist in maintaining the prop in position between flap 87 and bathtub 54. Those of skill in the art will appreciate that prop 93 is sized commensurate with the associated drain in keeping with the spirit of the invention; namely, to bias flap 87 somewhat away from opening 90 to facilitate drainage. Prop 93 may be preferably about the size of a standard golf ball, but may be formed of any suitable size or shape that will created a gap between flap 87 and the adjacent surface of bathtub 54 or liner system 60. In some embodiments, flap 87 further includes a plug 92 and a rim 88 (not shown). Plug 92 may be coupled to second portion 91, and plug 92 may be configured to selectively seal rim 88.

Referring again to FIG. 12, in one embodiment, bottom portion 87 includes one or more magnets 71 secured to liner 10 adjacent to opening 90. In this embodiment, flap 87 includes a corresponding attachment feature 79 located at second portion 91. Attachment feature 79 may be a magnet or a portion of ferrous material configured for magnetic attachment to magnet 71. When magnetically secured, magnet 71 and attachment feature 79 are configured to allow flap 87 to attach more securely to bottom portion 78 to maintain flap 87 away from opening 90 to facilitate smooth, rapid water drainage. Alternatively to a magnetic connection, any suitable connection may secure flap 87 away from opening 90 for drainage, such as hook and loop fasteners, suction cups, or zip-locking interlocking edges.

Referring to FIGS. 14-17, in one embodiment basin 62 may also include an overflow system 95 proximate anchor ledge 70. Overflow system 95 is configured to allow fluid to drain from basin 62 at a high level if the fluid supply is left running inadvertently. Overflow system 95 may include a shallow sleeve 96 having a rim 97 coupled or sealed to an opening 98 in basin 62. Preferably, overflow system 95 is formed of plastic, rubber or other suitable material. Sleeve 96 includes one or more side openings 99 for fluid drainage and may be configured to receive or align with an existing overflow (not shown) of bathtub 54. In an alternative embodiment, drain system 84 may have a structure similar to overflow system 95, where cup 86 may be a shallow sleeve with one or more side openings 99 for fluid drainage.

Figure 18:
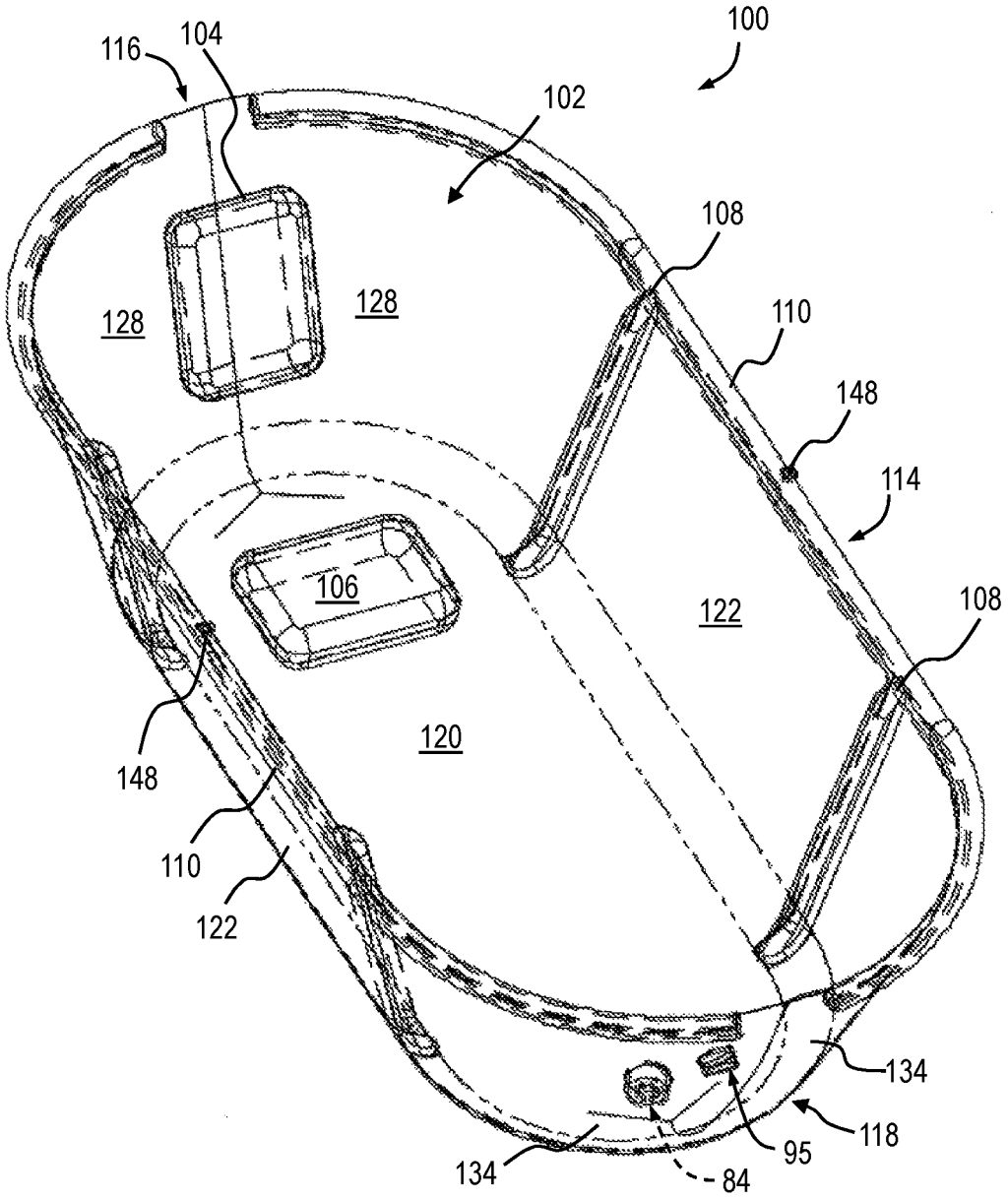
FIG. 18 is a perspective view of a bathtub liner system shown transparent according to another embodiment of the present invention.
Figure 19:
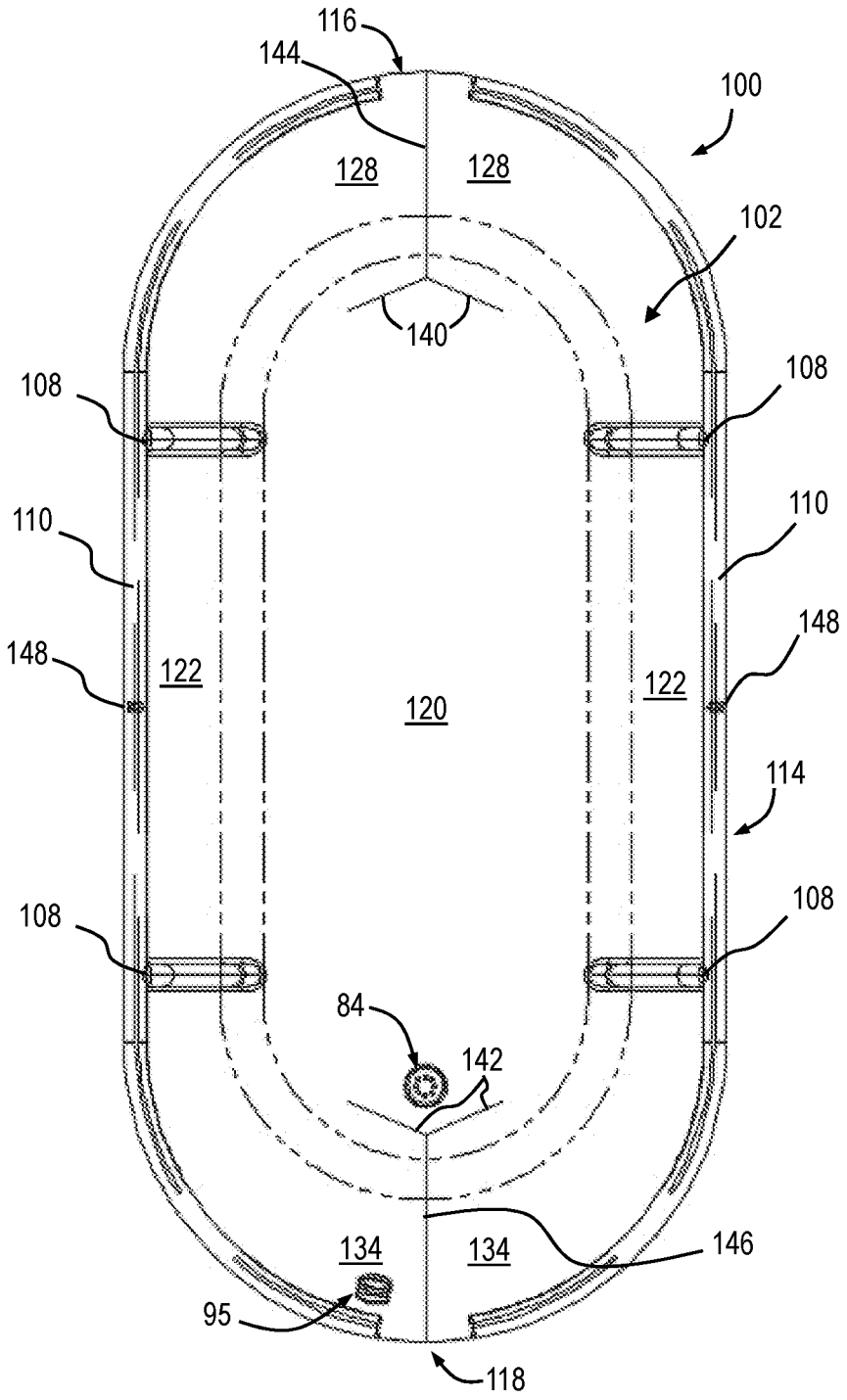
FIG. 19 is top plan view of the liner system of FIG. 18 without the cushions.
Figure 20:
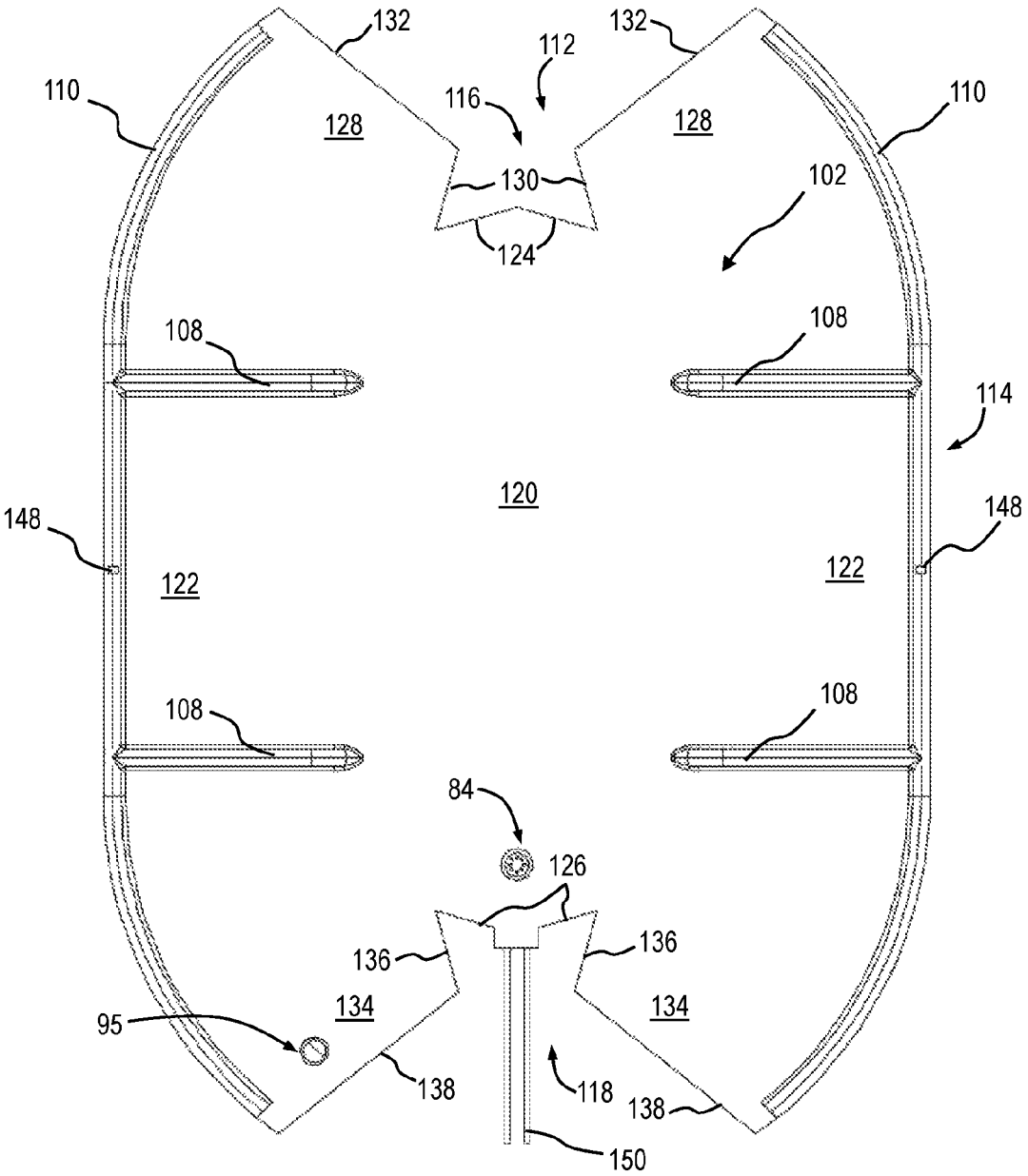
FIG. 20 is top plan view of the unassembled basin with frame of FIG. 18.
Figure 21:
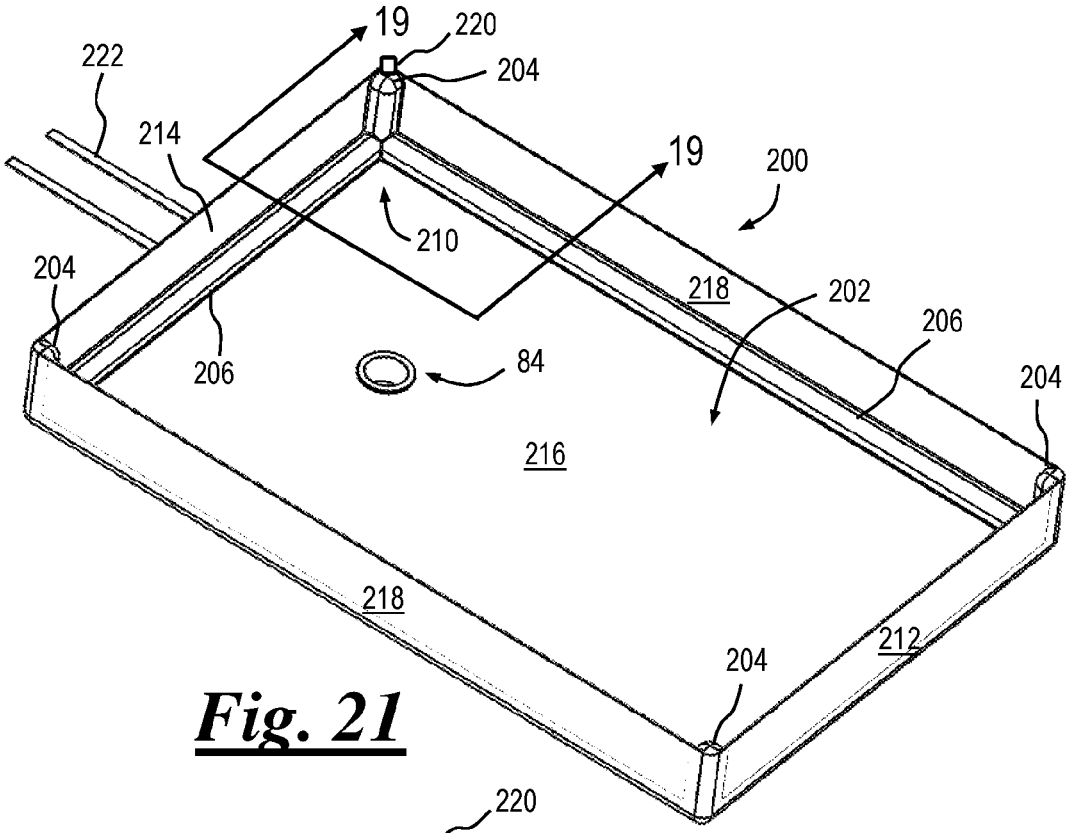
FIG. 21 is a perspective view of a shower liner system according to another embodiment of the present invention.
Figure 22:
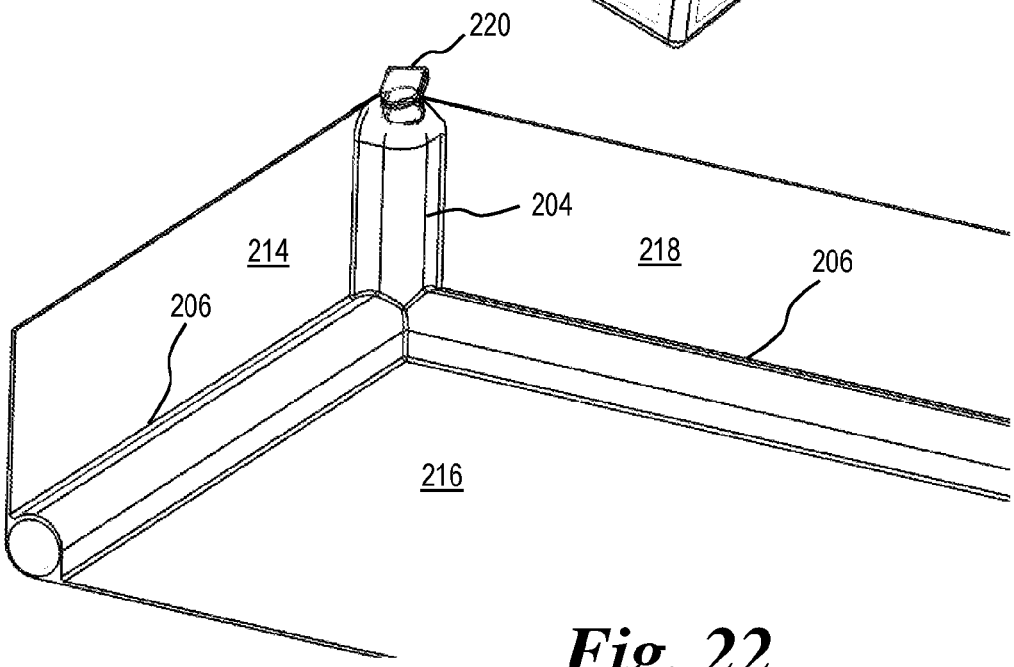
FIG. 22 is a side perspective view in section of FIG. 21.
Figure 23:
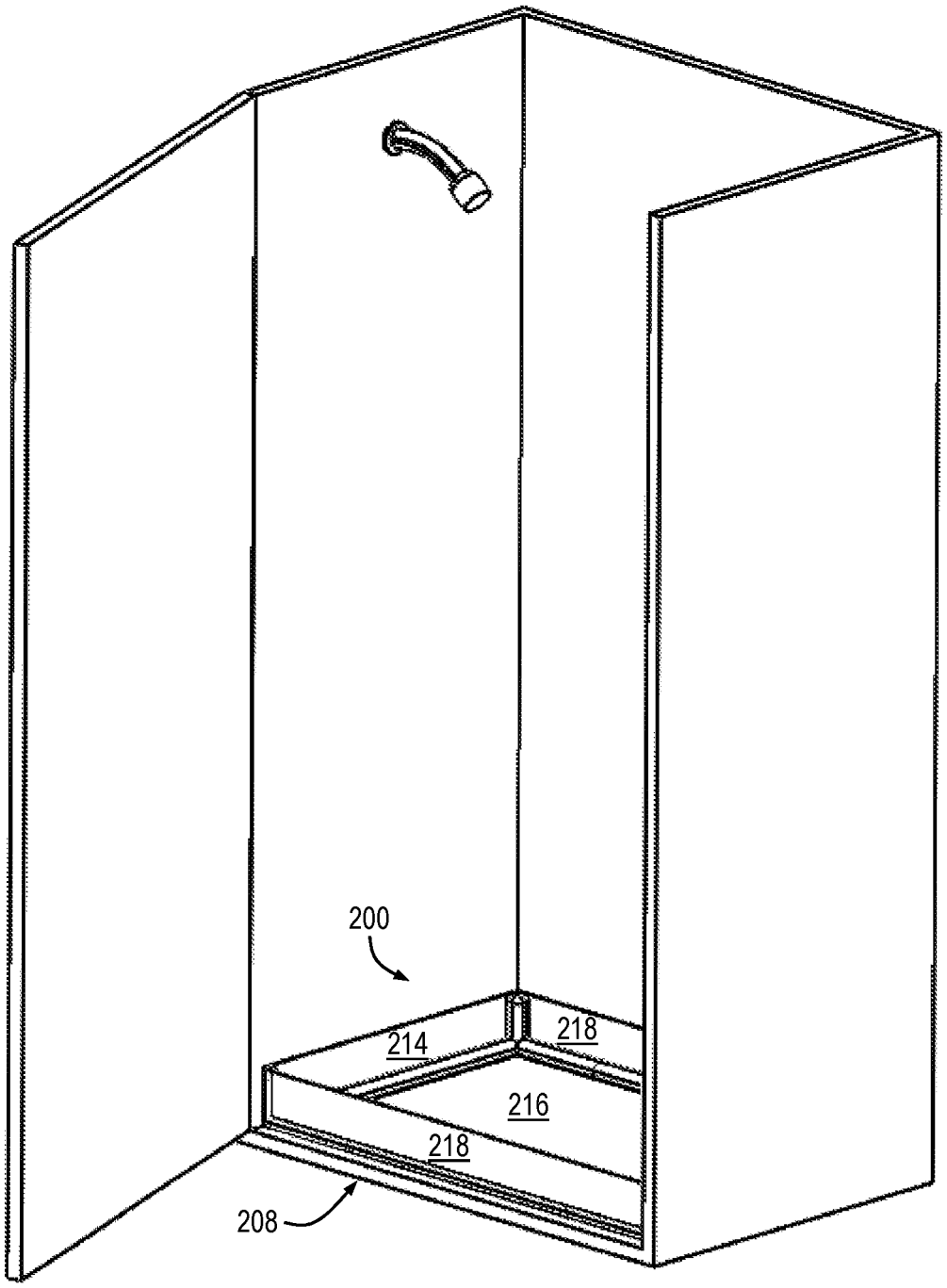
FIG. 23 is an assembled view of the liner system of FIG. 21 with the shower.
Figure 24:
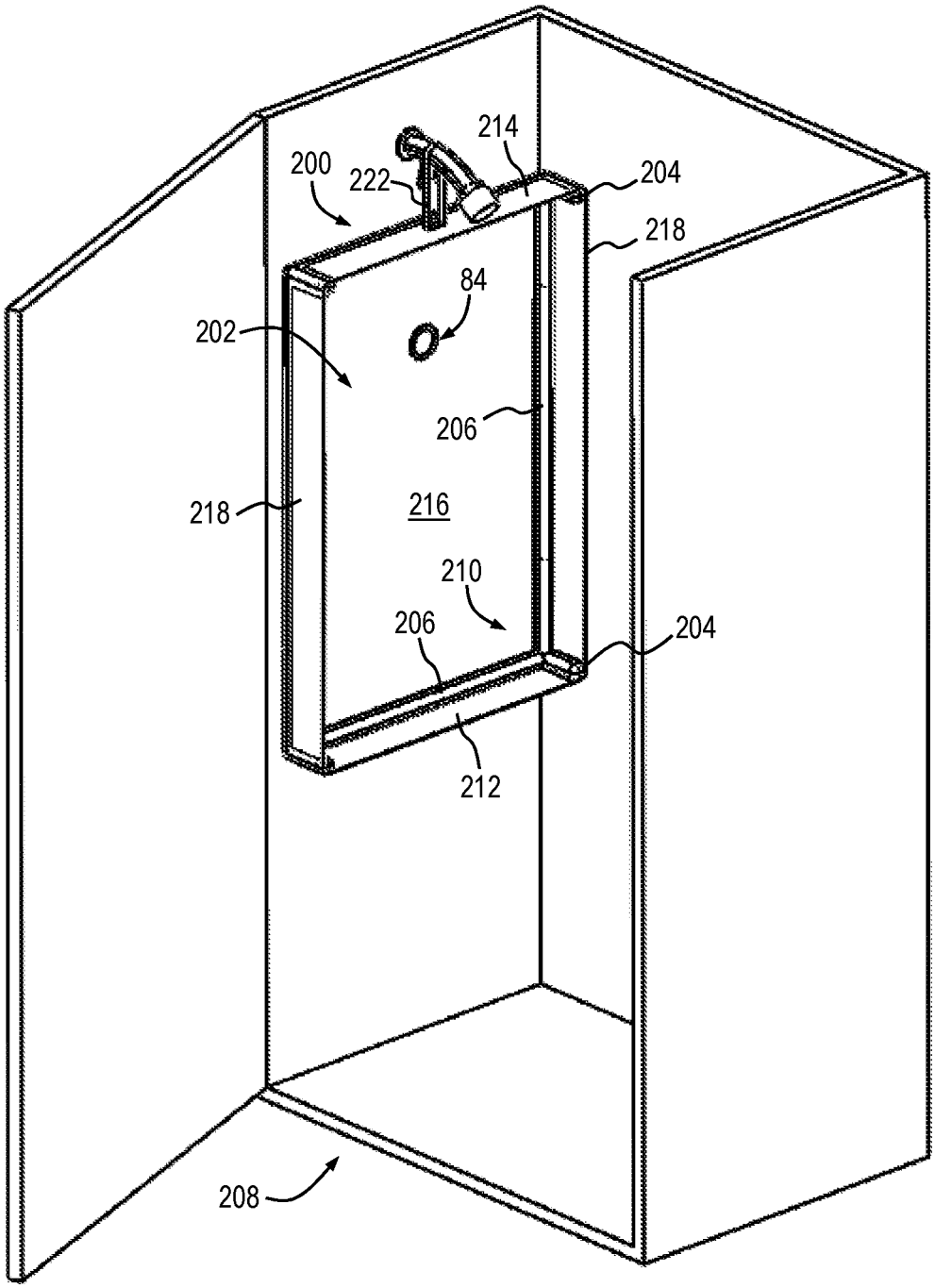
FIG. 24 is a top perspective view of the liner system of FIG. 21 shown hanging in the shower to dry.

The general arrangement of a bathtub liner system 100 is shown in FIGS. 18-20 according to another embodiment of the present invention. Liner system 100 includes a basin 102, an attachable back cushion 104 and an attachable seat cushion 106. Liner system 100 may optionally include support ribs 108 and a pair of opposing anchor ledges 110. Anchor ledges 110 are connected to an upper periphery of basin 102, and each forms a continuous enclosure configured to receive and contain any suitable material that provides selective semi-rigidity. Liner system 100 is configured to be prefabricated from a pattern 112 (see FIG. 20) to be utilized within an ovaloid or other suitable shaped bathtub or receptacle (not shown).

In use, basin 102 is configured to receive and contain water or other suitable material. Further, liner system 100 is configured to be selectively secured against a bathtub or other suitable receptacle. Fluids or other materials supplied to liner system 100 apply force which acts to selectively secure the system to the adjacent surface of a bathtub. Support ribs 108 couple to anchor ledges 110 to form a frame 114 which acts to support liner system 100 while being filled with fluid and during use. Frame 114 is configured to selectively secure the bathtub liner system 100 against the adjacent surface of a bathtub.

Referring to FIG. 20, preferably, pattern 112 is made as a one-piece, unitary construction. Basin 102 includes a first end portion 116 and an opposing, second end portion 118, each of which extends from a bottom portion 120. First and second end portions 116, 118 also extend from opposing side portions 122, each of which extends from bottom portion 120. Bottom portion 120 includes first bottom edge 124 and a second bottom edge 126. First end portion 116 includes a pair of opposing first end flaps 128 having opposing first end edges 130 and opposing first end side edges 132. Second end portion 118 includes a pair of opposing second end flaps 134 having opposing second end edges 136 and opposing second end side edges 138.

Bottom portion 120 may include a drain system 84 and basin 102 may include an overflow system 95 proximate anchor ledge 110. Liner system 100 may further include one or more ties 150 connected to or extending from basin 102. Ties 150 are configured to allow liner system 100 to be hung (e.g. on a rod, shower head piping or clothes line) to air dry after use or after cleaning. Ties 150 may be formed from any suitable durable material, such as plastic, capable of supporting the weight of liner system 100, and may include one or magnets. Although shown as a pair of straps, ties 150 may be formed as any suitable member, such as, without limitation, a loop or a hook.

As seen in FIGS. 19 and 20, in assembly of liner system 100, a first bottom seam 140 is formed by the joining of first bottom edge 124 to first end edges 130, and a second bottom seam 142 is formed by the joining of second bottom edge 126 to second end edges 136. Further, a first end seam 144 is formed by the joining of first end side edges 132 and a second end seam 146 is formed by the joining of second end side edges 138. Seams 140, 142, 144, 146 may be formed by any suitable fastening feature such as ultrasonic welding, heat sealing, fastener, bonding, adhesive or sewing.

In further assembly of liner system 100, attachable back cushion 104 may be coupled by any suitable attachment type, such as by heat welding onto first end portion 116, and attachable seat cushion 106 may be coupled by any suitable attachment type, such as by heat welding onto second end portion 118. Back cushion 104 and seat cushion 106 are otherwise similar to back cushion 64 and seat cushion 66 as detailed above. Support ribs 108 and anchor ledges 110 are similar to support ribs 68 and anchor ledge 70 as detailed above. Each anchor ledge 110 may include one or more ledge portals 148 similar to ledge portals 82 and configured to allow fluid or other flowable material that provides selective semi-rigidity to be supplied to or discharged from the anchor ledges, and thus each half of frame 114. The user may supply air to and discharge air from each half of frame 114 through the ledge portals 148. In some embodiments bathtub liner system 100 may be devoid of either of back cushion 104, seat cushion 106, support ribs 108 and anchor ledge 110.

The general arrangement of a liner system 200 for a shower is shown in FIGS. 21-24 according to another embodiment of the present invention. Liner system 200 includes a basin 202, and may optionally include support ribs 204 and wall supports 206. Wall supports 206 are connected to a lower periphery of basin 202, and form a continuous enclosure configured to receive and contain water or any other suitable material that provides selective semi-rigidity. Liner system 200 is configured to be prefabricated to be pre-conformed to the contours of a typical shower base 208 (see FIG. 23).

In use, basin 202 is configured to receive and drain a fluid. Liner system 200 is configured to be selectively secured against shower base 208 or other suitable receptacle. Fluids or other materials impinging upon liner system 200 apply force which acts to selectively secure the system to the adjacent surface of shower base 208. Support ribs 204 couple to wall supports 206 to form a frame 210 which acts to support liner system 200 while being impinged with fluid and during use. Frame 210 is configured to selectively secure the liner system 200 against the adjacent surface of shower base 208. Preferably, liner system 200 is made as a one-piece, unitary construction.

Basin 202 includes a first end portion 212 and an opposing, second end portion 214, each of which connects to a bottom portion 216. First and second end portions 212, 214 also connect to opposing side portions 218, each of which connects to the bottom portion 216. Basin 202 may include radius portions where the ends, sides and bottom portions meet. Although the shape of basin 202 is shown as generally rectangular, the shape may be square, oval, ovaloid, ovoid, circular, or a combination thereof.

Support ribs 204 and wall supports 206 are similar to support ribs 68 and anchor ledge 70 as detailed above. Although supports ribs 204 are shown at each corner of basin 202, the support ribs may also be located at any position along the sides or ends of the basin. Although wall supports 206 are shown adjacent the bottom portion 216, the wall supports may also be located at any position along the sides and/or ends of basin 202. Additionally, or alternatively, wall supports 206 may be included along the upper periphery of basin 202. Frame 210 may include one or more ledge portals 220 similar to ledge portals 82 and configured to allow fluid or other flowable material that provides selective semi-rigidity to be supplied to or discharged from the wall supports 206 and/or support ribs 204. The user may supply air to and discharge air from frame 210 through the ledge portals 220.

Bottom portion 216 also includes a drain system 84 configured to allow drainage of fluid during use of liner system 200. Drain system 84 may be received by or aligned with an existing drain of shower base 208. Liner system 200 may also include one or more ties 222 to allow for the liner system to be air dried. Ties 222 are similar to ties 150 described above.

Liner systems 60, 100, 200 may be formed from any suitable, rigid, semi-rigid, or flexible material, such as, without limitation, plastic, rubber, or flexible polypropylene. Preferably, the liner material may include biodegradable ethylene vinyl acetate (EVA), polyethylene vinyl acetate (PEVA) or other similar vinyl replacement sheeting product that is PVC-free and non-chlorinated. The liner material is configured to have high tolerance to heat, to limit off gassing of hazardous fumes, to be non-reactive with other chemicals, and to be available in different colors, embossments and patterns. The liner systems 60, 100, 200 may be formed from a single layer or multiple layers of material, and are configured to be reusable and machine washable. Liner systems 60, 100, 200 may include portions with a texturized upper surface to help prevent slippage of the user when getting in and out of the liner system. Further, a non-skid finish or feature may be included on the interior and/or exterior surfaces of liner systems 60, 100, 200. A non-limiting example of a non-skid finish may include forming a texturized surface of raised dots or ribs to prevent slippage. Preferably, both the interior and exterior surfaces of bottom portions 78, 120, 216 include non-skid finishes to allow the user to stand safely, and to assist in securing liner systems 60, 100, 200 in place without sliding or movement when used within bathtubs or showers.

Joints or seams in the material of liner systems 60, 100, 200 may be joined by any suitable fastening feature such as ultrasonic welding, heat sealing, fastener, bonding, adhesive or sewing. Preferably, heat welding of the liner material portions is used to create a one-piece, integral, leak-proof liner system. In one embodiment, liner systems 60, 100, 200 may be formed out of a seamless sheet of material and contoured into a corresponding receptacle shape with a press or by other suitable means. Such seamless liners may include ridges or flutes in the end portions to adapt to various shaped receptacles. In one embodiment, liner systems 60, 100, 200 may be configured to be custom pre-conformed to match the shape, contour and ledge of a select bathtub, including any cutouts needed to coordinate with existing plumbing features or locating drain system 84 to align above the existing bathtub drain. The liner systems 60, 100, 200 may also be configured with varied dimensions for use with any size and shape suitable receptacles, such as bathtubs, showers, barrels, tanks, totes, sinks or basins.

Figure 17:
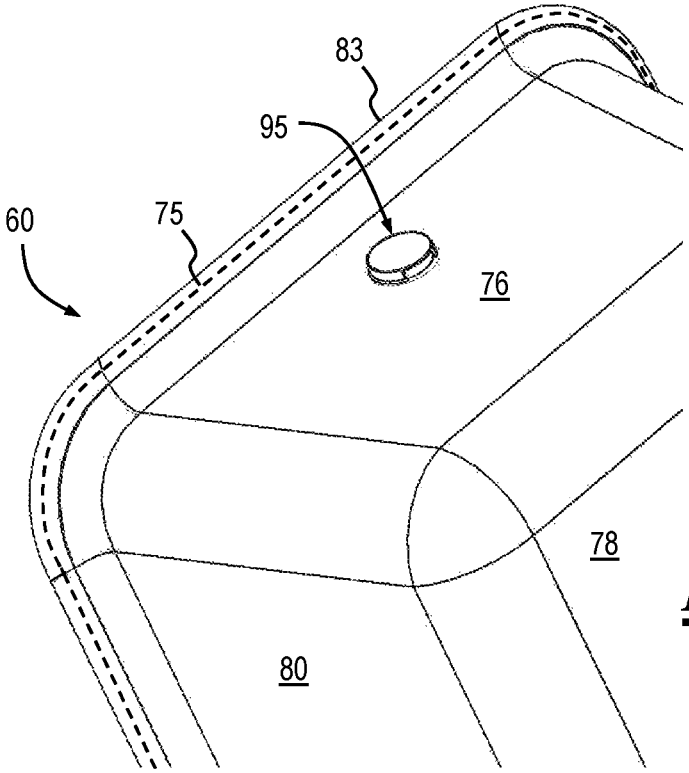
FIG. 17 is rear bottom exterior view of a basin with flange having an adhesive strip according to another embodiment of the present invention.

In one embodiment, the material of liner systems 60, 100, 200 may include an elastic polymer added into the EVA solution, and forming the liner over a mold, which would create a basic shape that may be stretched and conformed with the shape of the bathtub. In one embodiment, liner systems 60, 100, 200 may be formed of any suitable biodegradable material, and configured for a one time use and to be disposable. In some embodiments, suction cups, adhesive portions or magnets may be coupled to the liner systems 60, 100, 200 to promote adhesion between the liner systems and bathtubs or shower bases. Referring to FIG. 17, in one embodiment, basin 62 may include upper flange 83 with a rear surface having an adhesive strip 75 disposed along at least a portion thereof. Adhesive strip 75 may include any suitable substance which provides selective securing of flange 83 to ledge 56 or upper portion of bathtub 54. Although adhesive strip 75 is shown disposed on flange 83, the adhesive strip may be located additionally or alternatively on other portions of basin 62.

In one embodiment, preparation for use of the bathtub liner system 60, back cushion 64 and seat cushion 66 may be inflated with air by the user. The liner system 60 may be placed into the desired position inside bathtub 54, and the user may inflate frame 72 with air through the ledge portal 82 and/or insert one or more inserts 73. Once frame 72 is semi-rigid, the user may straighten anchor ledge 70 to remove any kinks and couple plug 92 with cup 86 of drain system 84 for proper sealing. The user may then fill basin 62 with water to the desired level, while maintaining proper sealing of plug 92. After use for the desired period, the user then removes plug 92 from cup 86 to allow water to drain from basin 62. During or after drainage of basin 62, frame 72 may be deflated and/or inserts 73 removed. Liner system 60 may then be removed from bathtub 54, and back cushion 64 and seat cushion 66 deflated. The user may then either clean and/or drip-dry the used liner system 60 for reuse.

In the various embodiments described above, it is understood that some of the features of liner systems 10, 60, 100 and 200 may be interchanged. For example, bathtub liner system 60 may include a narrowed region 22 with a cutout 24 to coordinate with existing plumbing of the bathtub. In another example, bathtub liner system 60 may include panels 30, 40 that are coupled to basin 62. In a further example, bathtub liner system 60 may include only a cutout 26 for opening 90 in lieu of a complete drain system 84. The cutout 26 may be configured to surround existing drain 52 of bathtub 54.

While this invention has been shown and described with respect to detailed embodiments thereof, it will be understood by those skilled in the art that changes in form and detail thereof may be made without departing from the scope of the claims of the invention.

What is claimed is:

1. A bathtub liner system for a bathtub, comprising:

a basin, the basin including a first end portion, a second end portion and opposing side portions all extending from and adjacent to a bottom portion, the first end portion being adjacent to first ends of the side portions, the second end portion being adjacent to second ends of the side portions, the basin being configured to receive and contain a fluid;

a cushion coupled to an interior surface of the basin; and a drain system operatively coupled to the basin, the drain system configured to be selectively sealed to retain or drain the fluid at an opening in the basin, the drain system including a flap configured to selectively seal the opening in the basin, and a movable prop configured to be placed between the flap and an adjacent surface of the bathtub or liner system, the movable prop configured to bias the flap away from the opening to facilitate drainage;

wherein the movable prop is hollow, perforated, and sphere shaped, and configured to be placed between the flap and an adjacent surface of the bathtub or liner system to create a gap which assists with drainage of fluid from the basin;

the basin being pre-conformed to generally match a contour of at least a portion of the bathtub.

2. The bathtub liner system of claim 1, wherein the cushion is a back cushion extending from an interior surface of the first end portion.

3. The bathtub liner system of claim 2, wherein the back cushion is configured for selective inflation with fluid.

4. The bathtub liner system of claim 2, wherein the back cushion is selectively coupled to the basin.

5. The bathtub liner system of claim 2, wherein the back cushion is factory pre-filled with material and sealed.

6. The bathtub liner system of claim 1, wherein the cushion is a seat cushion extending from an interior surface of the bottom portion.

7. The bathtub liner system of claim 6, wherein the seat cushion is configured for selective inflation with fluid.

8. The bathtub liner system of claim 6, wherein the seat cushion is selectively coupled to the basin.

9. The bathtub liner system of claim 6, wherein the seat cushion is factory pre-filled with material and sealed.

10. The bathtub liner system of claim 1, further comprising an upper flange connected to or extending from at least a portion of an upper periphery of the basin and configured to be received by an adjacent ledge of the bathtub.

11. The bathtub liner system of claim 10, wherein the upper flange is configured to have at least a portion extend to a wall joint of the bathtub.

12. The bathtub liner system of claim 10, further comprising an adhesive strip disposed on a portion of a rear surface of the upper flange.

13. The bathtub liner system of claim 1, wherein the drain system includes a cup received by the opening in the basin and configured to be selectively sealed.

14. The bathtub liner system of claim 13, wherein the cup includes a rim coupled or sealed to the opening in the basin and openings for fluid drainage.

15. The bathtub liner system of claim 1, further comprising an anchor ledge connected to an upper periphery of the basin and configured for selective semi-rigidity in order to support the liner system against a ledge of the bathtub.

16. The bathtub liner system of claim 1, further comprising:

at least one semi-rigid stay positioned proximate a corner of the liner;

a magnet secured to the liner proximate the opening in the basin and a cooperating member secured to the flap.

17. The bathtub liner system of claim 1, further including an overflow system proximate an upper periphery of the basin.

18. A bathtub liner system for a bathtub, comprising:

a basin, the basin being formed by heat welding of separate liner material portions to be a one-piece member, the basin being configured to receive and contain a fluid;

a back cushion, the back cushion extending from an interior surface of a first end portion of the basin;

a seat cushion, the seat cushion extending from an interior surface of a bottom portion of the basin; and a drain system operatively coupled to the basin, the drain system configured to be selectively sealed to retain or drain the fluid at an opening in the basin, the drain system including a flap configured to selectively seal the opening in the basin, and a movable prop configured to be placed between the flap and an adjacent surface of the bathtub or liner system, the movable prop configured to bias the flap away from the opening to facilitate drainage;

wherein the movable prop is hollow, perforated, and sphere shaped, and configured to be placed between the flap and an adjacent surface of the bathtub or liner system to create a gap which assists with drainage of fluid from the basin;

the basin being pre-conformed to generally match a contour of at least a portion of the bathtub.

19. A method for assembling a bathtub liner system for a bathtub, comprising the steps of:

obtaining a basin including a first end portion, a second end portion, opposing side portions, and a bottom portion;

connecting the first and second end portions to extend from the bottom portion;

connecting the opposing side portions to extend from the bottom portion;

connecting the first end portion to first ends of the side portions;

connecting the second end portion to second ends of the side portions;

pre-conforming the basin to generally match a contour of at least a portion of the bathtub;

configuring the basin to receive and contain a fluid;

coupling a cushion to an interior surface of the basin; and operatively coupling a drain system to the basin, the drain system configured to be selectively sealed to retain or drain the fluid at an opening in the basin, the drain system including a flap configured to selectively seal the opening in the basin, and a movable prop configured to be placed between the flap and an adjacent surface of the bathtub or liner system, the movable prop configured to bias the flap away from the opening to facilitate drainage;

wherein the movable prop is hollow, perforated, and sphere shaped, and configured to be placed between the flap and an adjacent surface of the bathtub or liner system to create a gap which assists with drainage of fluid from the basin.

20. The bathtub liner system of claim 17, wherein the overflow system includes a shallow sleeve having a rim coupled to an opening in the basin.

* * * * *